US009994983B2

(12) United States Patent
Knopf

(10) Patent No.: US 9,994,983 B2
(45) Date of Patent: Jun. 12, 2018

(54) NEEDLE BOARD

(71) Applicant: Oskar Dilo Maschinenfabrik KG, Eberbach (DE)

(72) Inventor: Trudbert Knopf, Sinsheim (DE)

(73) Assignee: Oskar Dilo Maschinenfabrik KG (DE)

( * ) Notice: Subject to any disclaimer, the term of this patent is extended or adjusted under 35 U.S.C. 154(b) by 15 days.

(21) Appl. No.: 15/342,745

(22) Filed: Nov. 3, 2016

(65) Prior Publication Data

US 2017/0130381 A1 May 11, 2017

(30) Foreign Application Priority Data

Nov. 6, 2015 (EP) ..... 15193390

(51) Int. Cl.
*D04H 18/02* (2012.01)
*D04H 18/00* (2012.01)

(52) U.S. Cl.
CPC ..... *D04H 18/02* (2013.01); *D04H 18/00* (2013.01)

(58) Field of Classification Search
CPC ..... D04H 18/02; D04H 18/00; D04H 1/46; D04H 3/102; D04H 3/105; D04H 5/02; D04H 13/005; D04H 1/498; D05B 55/10; D05B 55/00
USPC ..... 28/107, 109, 115
See application file for complete search history.

(56) References Cited

U.S. PATENT DOCUMENTS 3,199,166 A * 8/1965 Petersik ..... D04H 18/02 28/107
3,219,732 A * 11/1965 Smith, II ..... D04H 18/00 264/45.3
3,397,436 A * 8/1968 Zocher ..... D04H 18/00 28/115
3,526,349 A * 9/1970 Toshio ..... B26F 1/24 225/3
4,937,924 A * 7/1990 Leuchtenmuller ..... D04H 18/02 28/107
5,148,584 A * 9/1992 Fehrer ..... D04H 18/00 28/115
9,260,806 B2 * 2/2016 Dilo ..... D04H 18/02
2008/0313873 A1 * 12/2008 Link ..... D04H 18/02 28/108
2010/0162543 A1 * 7/2010 Dilo ..... D04H 18/00 28/115

(Continued)

FOREIGN PATENT DOCUMENTS

EP 2138616 A1 12/2009
EP 2918719 A1 9/2015

*Primary Examiner* — Amy Vanatta
(74) *Attorney, Agent, or Firm* — Jansson Munger McKinley & Kirby Ltd.

(57) ABSTRACT

The needle board for use in a needling machine for needling a flat textile material comprises first needle rows and second needle rows, wherein the first needle rows and the second needle rows are arranged inclined with respect to a longitudinal direction of the needle board, which longitudinal direction corresponds to a direction in which the flat textile material to be needled is conveyed in the needling machine. The first needle rows are arranged at a first angle to the longitudinal direction, and the second needle rows are arranged at a second angle to the longitudinal direction. An absolute value of the second angle is different from an absolute value of the first angle.

23 Claims, 2 Drawing Sheets

(56) References Cited

U.S. PATENT DOCUMENTS

2014/0373322 A1* 12/2014 Gautier ..... D04H 1/4242
28/107

* cited by examiner

NEEDLE BOARD

CROSS REFERENCE TO RELATED APPLICATION

This application claims priority based on European patent application EP 15 193 390.0 filed Nov. 6, 2015. The entire disclosure and contents of this application is incorporated by reference into the present application.

FIELD

The present invention relates to a needle board, and more particularly, to a needle board for use in a needling machine for needling a flat textile material such as a nonwoven, a woven fabric or a laid material.

BACKGROUND

When flat textile materials are needled, especially nonwovens, it is desirable to achieve the most uniform possible needling without the formation of patterns in the flat textile material. It has been found advantageous for this purpose for rows of needles to be arranged in a herringbone pattern and not simply to extend in rows and columns in the longitudinal and transverse directions of the needle board. Nevertheless, stripes or patternings still occur in the needled flat textile material, especially at high feed-per-stroke ratios.

It is an object of the present invention to provide a needle board for use in a needling machine for needling a flat textile material of which a uniformly needled flat textile material is obtained even at high feed-per-stroke ratios or over a wider feed range of the needling machine.

SUMMARY

According to an aspect of the invention, the needle board for use in a needling machine for needling a flat textile material comprises first needle rows and second needle rows, wherein the first needle rows and the second needle rows are arranged inclined with respect to a longitudinal direction of the needle board, which longitudinal direction corresponds to a direction in which the flat textile material to be needled is conveyed in the needling machine. The first needle rows are arranged at a first angle to the longitudinal direction, wherein the second needle rows are arranged at a second angle to the longitudinal direction. An absolute value of the second angle is different from an absolute value of the first angle.

Through variation of the absolute values of the angles and the nonuniform distribution of the needles in the needle board thus achieved, the formation of patternings in the needled flat material can be prevented even at high conveying speeds of the flat textile material through the needling machine in the great majority of cases. This is highly preferable.

Preferably, the first needle rows are arranged in a first block, and the first needle rows of the first block are parallel to each other. Further, preferably the second needle rows are arranged in a second block, wherein the second needle rows of the second block are parallel to each other.

It is also preferable to promote the further homogenization of the stitching pattern in the needled flat textile material, the needle board comprises a plurality of first blocks and a plurality of second blocks, wherein the first blocks and the second blocks are arranged to form a herringbone pattern.

An especially homogeneous stitching pattern is preferably obtained when the first needle rows and the second needle rows are arranged in such a way that a first projection of the first needle rows and of the second needle rows in or opposite to the longitudinal direction of the needle board yields at least certain sections in a transverse direction of the needle board, the transverse direction being perpendicular to the longitudinal direction of the needle board, in which sections transverse distances between first individual needle projections are equal.

It is highly preferred that to obtain a satisfactory stitching density, the transverse distances between the first individual needle projections are in the range of 0.05-2.5 mm, preferably of 0.1-1.5 mm, and more preferably of 0.2-1.0 mm.

Furthermore, preferably the first needle rows and the second needle rows are arranged in such a way that a second projection of the first needle rows and of the second needle rows in a transverse direction of the needle board, the transverse direction being perpendicular to the longitudinal direction of the needle board, yields at least certain sections in the longitudinal direction of the needle board, where longitudinal distances between second individual needle projections are different.

Preferably, when the needles in all of the first and second needle rows are spaced equally apart, this result is obtained automatically, thanks to the different absolute values selected for the first and second angles of the needle rows to the longitudinal direction of the needle board. All of the needle rows of a block of needle rows are usually arranged next to each other in such a way that the same needles of each needle row, i.e., all of the needles in the first position, all of the needles in the second position etc., together form a line extending in the transverse direction. From this follows in turn that the transverse projections of the needles within a block of needle rows comprise the same longitudinal distances from each other.

The transverse projections of the needles within a first block of first needle rows comprise first longitudinal distances from each other in the range of 0.5-20 mm, preferably of 1.0-15 mm, and more preferably of 2.0-5.0 mm.

The transverse projections of the needles within a second block of second needle rows comprise second longitudinal distances to each other in the range of 0.3-15 mm, preferably of 0.7-10 mm, and more preferably of 1.5-4.0 mm.

It has been found to be especially preferable for the absolute value of the first angle of the first needle rows to the longitudinal direction of the needle board to be in the range of 10-30°, preferably of 15-25°, and more preferably of 17-23°.

It has also been found preferable and advantageous for the absolute value of the second angle of the second needle rows to the longitudinal direction of the needle board to be in the range of 25-65°, preferably of 30-60°, and more preferably of 42-48°.

A needle row usually preferably comprises 5-40 needles. In a preferred embodiment, the needles of each needle row are connected to each other and thus form a needle module, which is arranged in a slot in the needle board.

BRIEF DESCRIPTION OF THE DRAWINGS

The invention is explained in greater detail below with reference to the embodiments illustrated in the drawings.

DETAILED DESCRIPTION

Figure 1:
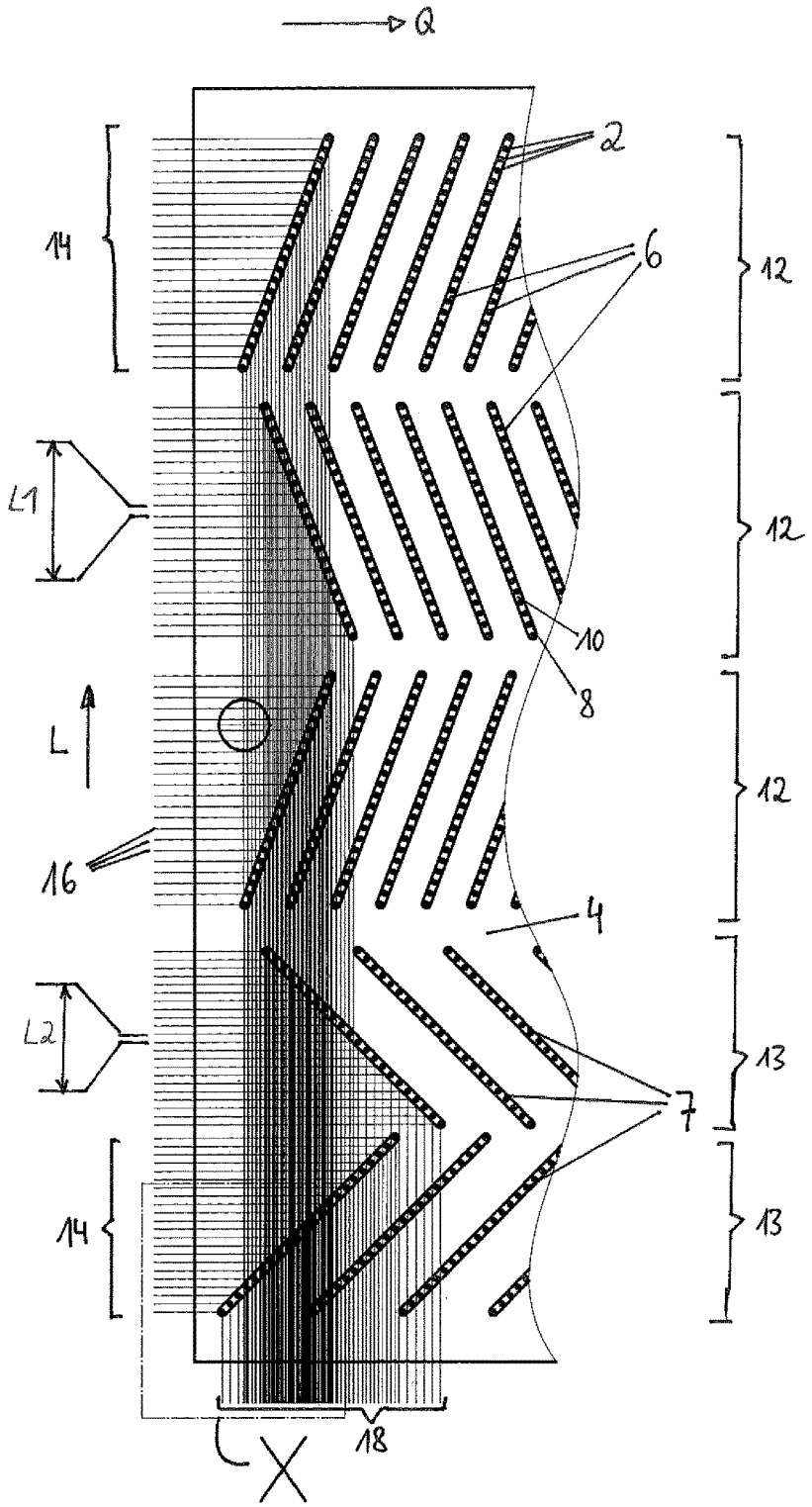
FIG. 1 is a top view of part of an embodiment of a needle board according to the invention.

FIG. 1 shows a top view of an embodiment of the needle board according to the invention. The individual needles 2 of the needle board are arranged in first needle rows 6 and second needle rows 7 and are indicated in this top view (FIG. 1) as dots. The tips of these needles 2 project into the plane of the drawing beyond the base body 4 of the needle board. In the embodiment shown, each first or second needle row 6, 7 comprises approximately 20 needles. A needle row 6, 7 usually comprises between 5 and 40 needles.

The expert is familiar with many different possible ways in which needles 2 can be attached to base body 4 of the needle board. These ways include in particular the insertion of individual needles 2 into individual bores in base body 4 of the needle board. It is also possible, as shown in FIG. 1, for individual needles 2 of a first or second needle row 6, 7 to be connected to each other to form a needle module 8, which in turn is inserted as a unit into a slot 10 in base body 4 of the needle board. First and second needle rows 6, 7 are formed in both of these cases.

First and second needle rows 6, 7 are preferably arranged in first and second blocks 12, 13. Needle rows 6, 7 are in turn arranged to form a herringbone pattern extending in the longitudinal direction L of the needle board. This is understood to mean an arrangement in which needle rows 6, 7 are arranged inclined with respect to longitudinal direction L of the needle board, in such a way that the angle of all needle rows 6, 7 of one block 12, 13 to longitudinal direction L of the needle board has a certain sign (+ or −), and the angle of all of first or second needle rows 6, 7 of a first or second block 12, 13 adjacent thereto in longitudinal direction L has the opposite sign. Often successive needle rows 6, 7 have the same absolute value for this angle, as a result of which a homogeneous herringbone pattern can be formed in parts of the needle board.

In the needle board shown in FIG. 1, a distinction is made between first needle rows 6, which are combined into first blocks 12, and second needle rows 7, which are combined into second blocks 13. It is clear from FIG. 1 that all of first or second needle rows 6, 7 of a specific first or second block 12, 13 are parallel to each other. In addition, the needles of first or second needle rows 6, 7 of a first or second block 12, 13 should ideally have the same spacing in the direction in which first or second needle rows 6, 7 extend, and, considered in longitudinal direction L of the needle board, first or second needle rows 6, 7 should begin and end at the same length, i.e., begin and end at points such that the rows are all of equal length. In the transverse direction Q of the needle board, first and second blocks 12, 13 can extend over the entire width of the needle board or over only parts of it.

In the following, the first and second angles $\alpha$, $\beta$ are always to be understood as the smaller of the two angles of intersection of a first or second needle row 6, 7 with a straight line extending in longitudinal direction L of the needle board. The absolute value of second angle $\beta$ of second needle rows 7 to longitudinal direction L of the needle board is different from the absolute value of first angle $\alpha$ of first needle rows 6 to longitudinal direction L of the needle board. The absolute value of first angle $\alpha$ of first needle rows 6 to longitudinal direction L of the needle board is in the range of 10-30°, preferably of 15-25°, and even more preferably of 17-23°. The absolute value of second angle $\beta$ of second needle rows 7 to longitudinal direction L of the needle board is in the range of 25-65°, preferably of 30-60°, and even more preferably of 42-48°.

First and second needle rows 6, 7 are arranged in such a way that a projection 14 of first and second needle rows 6, 7 in the transverse direction Q of the needle board, i.e., the direction perpendicular to the longitudinal direction of the needle board, yields at least certain sections in longitudinal direction L of the needle board where the longitudinal distances L1, L2 between the projections 16 of the individual needles are different. Projections 16 of the needles within a block 12, 13 of needle rows 6, 7 comprise the same longitudinal distances L1, L2 from each other.

In the present application, needle projections 16 within a first block 12 of first needle rows 6 are separated from each other by longitudinal distance L1, whereas needle projections 16 within a second block 13 of second needle rows 7 are separated from each other by longitudinal distance L2. Longitudinal distance L1 separating needle projections 16 within a first block 12 of first needle rows 6 is in the range of 0.5-20 mm, preferably of 1.0-15 mm, and even more preferably of 2.0-5.0 mm. Longitudinal distance L2 separating needle projections 16 within a second block 13 of second needle rows 7 is in the range of 0.3-15 mm, preferably of 0.7-10 mm, and even more preferably of 1.5-4.0 mm.

Figure 2:
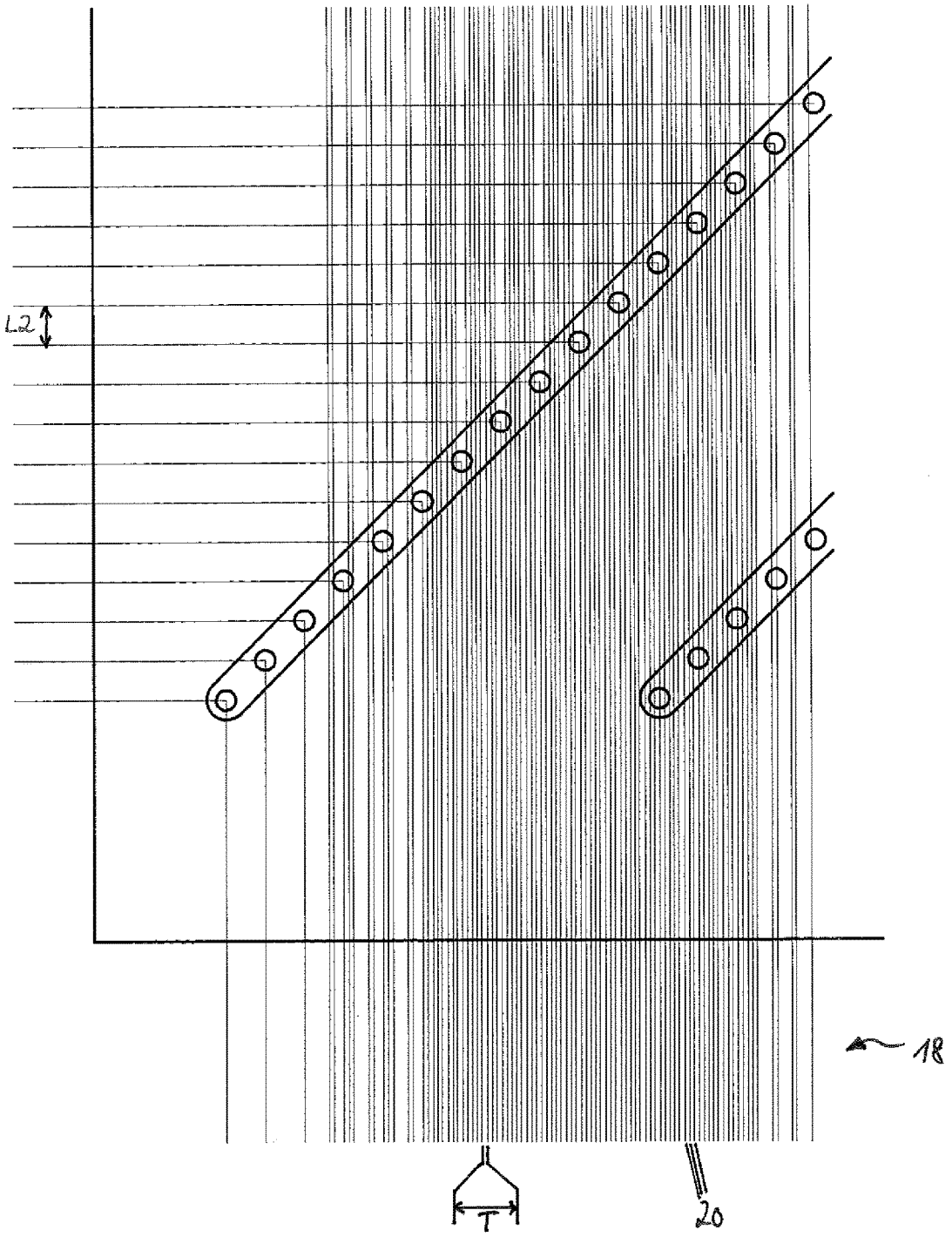
FIG. 2 is a top view of the detail marked "X" in FIG. 1.

It is especially preferable for needle rows 6, 7 to be arranged in such a way that a projection 18 of needle rows 6, 7 in or opposite to longitudinal direction L of the needle board yields at least certain sections in the transverse direction Q of the needle board, preferably large areas or the entire area, where the transverse distances T between individual needle projections 20 are equal. This is best seen in the enlarged diagram of the detail "X" in FIG. 2. The transverse distances T between individual needle projections 20 are in the range of 0.05-2.5 mm, preferably of 0.1-1.5 mm, and even more preferably of 0.2-1.0 mm.

It should be clear that the configuration of the needle board can be modified in many ways. This pertains to the number of needles 2 in each first and second needle row 6, 7, as well as to angles $\alpha$ and $\beta$ of needle rows 6, 7 to longitudinal direction L of the needle board, to the number of first and second needle rows 6, 7 within a first or second block 12, 13, to the spacing of individual needles 2 from each other within a first or second needle row 6, 7, and also to the distances between individual blocks 12, 13 or first and second needle rows 6, 7. It is also conceivable that the individual needles could be spaced apart in different ways within a needle row 6, 7.

The number of first and second blocks 12, 13 is also variable as is their arrangement with respect to each other. Five blocks 12, 13 are shown in FIG. 1, i.e., three first blocks 12 of first needle rows 6 and two second blocks 13 of second needle rows 7. First blocks 12 of first needle rows 6 are arranged one after the other, as are also second blocks 13 of second needle rows 7. It would also be conceivable that first and second blocks 12, 13 of first and second needle rows 6, 7 could be arranged in alternating fashion or in any other desired sequence.

Finally, first and second needle rows 6, 7 of first and second blocks 12, 13 in FIG. 1 are arranged to form a herringbone pattern extending in longitudinal direction L of the needle board. It would also be conceivable that angled first and second needle rows 6, 7 could be arranged differently, e.g., two or more successive first or second blocks 12, 13 at a positive angle to longitudinal direction L and at least one other first or second block 12, 13 at a negative angle to longitudinal direction L or vice versa.

The invention has been described so far on the basis of first and second blocks 12, 13 of first and second needle rows 6, 7 arranged to form a herringbone pattern. First and second needle rows 6, 7 could also be arranged next to each other in such a way as to form a herringbone pattern without forming first and second blocks 12, 13.

A wide variety of materials are available for the various parts discussed and illustrated herein. While the principles of this device have been described in connection with specific embodiments, it should be understood clearly that these descriptions are made only by way of example and are not intended to limit the scope of the device.

I claim:

1. A needle board for use in a needling machine for needling a flat textile material comprising first needle rows and second needle rows, the first needle rows and the second needle rows are arranged inclined with respect to a longitudinal direction of the needle board, which longitudinal direction corresponds to a direction in which the flat textile material to be needled is conveyed in the needling machine, the first needle rows are arranged at a first angle to the longitudinal direction and the second needle rows are arranged at a second angle to the longitudinal direction, and an absolute value of the second angle is different from an absolute value of the first angle.

2. The needle board of claim 1 wherein the first needle rows are arranged in a first block, wherein the first needle rows of the first block are parallel to each other, and the second needle rows are arranged in a second block, wherein the second needle rows of the second block are parallel to each other.

3. The needle board of claim 2 wherein the needle board comprises a plurality of first blocks and a plurality of second blocks, wherein the first blocks and the second blocks are arranged to form a herringbone pattern.

4. The needle board of claim 2 wherein the first needle rows and the second needle rows are arranged in such a way that a first projection of the first needle rows and of the second needle rows in or opposite to the longitudinal direction of the needle board yields at least certain sections in a transverse direction of the needle board, the transverse direction being perpendicular to the longitudinal direction of the needle board, in which sections transverse distances between first individual needle projections are equal.

5. The needle board of claim 4 wherein the transverse distances between the first individual needle projections are in the range of 0.05-2.5 mm.

6. The needle board of claim 4 wherein the transverse distances between the first individual needle projections are in the range of 0.1-1.5 mm.

7. The needle board of claim 4 wherein the transverse distances between the first individual needle projections are in the range of 0.2-1.0 mm.

8. The needle board of claim 2 wherein the first needle rows and the second needle rows are arranged in such a way that a second projection of the first needle rows and of the second needle rows in a transverse direction of the needle board, the transverse direction being perpendicular to the longitudinal direction of the needle board, yields at least certain sections in the longitudinal direction of the needle board, where longitudinal distances between second individual needle projections are different.

9. The needle board of claim 8 wherein first longitudinal distances between the second individual needle projections of needles of the first needle rows within the first block are equal.

10. The needle board of claim 9 wherein the first longitudinal distances are in the range of 0.5-20 mm.

11. The needle board of claim 9 wherein the first longitudinal distances are in the range of 1.0-15 mm.

12. The needle board of claim 9 wherein the first longitudinal distances are in the range of 2.0-5.0 mm.

13. The needle board of claim 8 wherein second longitudinal distances between the second individual needle projections of needles of the second needle rows within the second block are equal.

14. The needle board of claim 13 wherein the second longitudinal distances are in the range of 0.3-15 mm.

15. The needle board of claim 13 wherein the second longitudinal distances are in the range of 0.7-10 mm.

16. The needle board of claim 13 wherein the second longitudinal distances are in the range of 1.5-4.0 mm.

17. The needle board of claim 1 wherein the absolute value of the first angle of the first needle rows to the longitudinal direction of the needle board is in the range of 10-30°.

18. The needle board of claim 1 wherein the absolute value of the first angle of the first needle rows to the longitudinal direction of the needle board is in the range of 15-25°.

19. The needle board of claim 1 wherein the absolute value of the first angle of the first needle rows to the longitudinal direction of the needle board is in the range of 17-23°.

20. The needle board of claim 1 wherein the absolute value of the second angle of the second needle rows to the longitudinal direction of the needle board is in the range of 25-65°.

21. The needle board of claim 1 wherein the absolute value of the second angle of the second needle rows to the longitudinal direction of the needle board is in the range of 30-60°.

22. The needle board of claim 1 wherein the absolute value of the second angle of the second needle rows to the longitudinal direction of the needle board is in the range of 42-48°.

23. The needle board of claim 1 wherein each of the first needle rows and each of the second needle rows comprises between 5 and 40 needles.

* * * * *